US008855513B2

(12) United States Patent
Murakami et al.

(10) Patent No.: US 8,855,513 B2
(45) Date of Patent: Oct. 7, 2014

(54) IMAGE FORMING APPARATUS

(75) Inventors: Susumu Murakami, Osaka (JP); Toshiki Takiguchi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/597,349

(22) Filed: Aug. 29, 2012

(65) Prior Publication Data

US 2013/0058668 A1 Mar. 7, 2013

(30) Foreign Application Priority Data

Sep. 2, 2011 (JP) ..... 2011-191275

(51) Int. Cl.

*G03G 15/16* (2006.01)
*G03G 21/20* (2006.01)
*G03G 15/00* (2006.01)

(52) U.S. Cl.

CPC ..... *G03G 15/161* (2013.01); *G03G 2215/0132* (2013.01); *G03G 21/20* (2013.01); *G03G 2215/00084* (2013.01); *G03G 15/5033* (2013.01)

USPC ..... 399/44

(58) Field of Classification Search

CPC ..... G03G 21/20
USPC ..... 399/44
See application file for complete search history.

(56) References Cited

U.S. PATENT DOCUMENTS 5,019,871 A * 5/1991 Takeda et al. ..... 399/66
5,881,339 A * 3/1999 Yanagida et al. ..... 399/101
7,187,893 B2 * 3/2007 Takahata et al. ..... 399/302
7,697,855 B2 * 4/2010 Fukami et al. ..... 399/44
8,422,900 B2 * 4/2013 Aoki et al. ..... 399/66
8,611,776 B2 * 12/2013 Kozuma et al. ..... 399/71
2007/0201897 A1 * 8/2007 Maeda et al. ..... 399/101
2007/0206970 A1 * 9/2007 Izumi et al. ..... 399/101
2010/0284705 A1 * 11/2010 Aoki et al. ..... 399/66
2011/0150512 A1 6/2011 Tamagaki
2011/0262170 A1 * 10/2011 Kozuma et al. ..... 399/71

FOREIGN PATENT DOCUMENTS

JP H07-334012 A 12/1995
JP 2001-034139 * 2/2001 ..... G03G 21/14
JP 2001-034139 A 2/2001
JP 2002-072713 A 3/2002
JP 2002-156843 A 5/2002
JP 2006-091458 4/2006
JP 2006-251138 9/2006
JP 2007-047553 * 2/2007 ..... G03G 21/00
JP 2007-241285 * 9/2007 ..... G03G 15/16
JP 2007-241285 A 9/2007
JP 2011-150311 A 8/2011

* cited by examiner

*Primary Examiner* — Clayton E Laballe
*Assistant Examiner* — Kevin Butler
(74) *Attorney, Agent, or Firm* — Renner, Otto, Boisselle & Sklar, LLP

(57) ABSTRACT

An image forming apparatus includes: a transfer portion that transfers a toner image from a first image forming element to a second image forming element when transfer voltage is applied; and a control portion, at time of cleaning the plurality of image forming elements, after integrally forming a cleaning toner image to be supplied to the first image forming element and the second image forming element on the surface of the photoreceptor along a revolving direction, that controls the application of the transfer voltage to the transfer portion to transfer the toner image in a manner such that the toner image is divided into at least four sections along the revolving direction, out of which at least two sections that are not adjacent to each other are transferred from the first image forming element to the second image forming element.

5 Claims, 7 Drawing Sheets

IMAGE FORMING APPARATUS

CROSS REFERENCE

This Nonprovisional application claims priority under 35 U.S.C. §119(a) on Patent Application No. 2011-191275 filed in Japan on Sep. 2, 2011, the entire contents of which are hereby incorporated by reference.

BACKGROUND OF THE INVENTION

The present invention relates to an electrophotographic image forming apparatus that transfers a toner image to a sheet of paper by using a plurality of image formation elements including a photoreceptor.

Some electrophotographic image forming apparatuses primarily transfer a toner image formed on a photoreceptor to an intermediate transfer element, and then secondarily transfer the toner image from the intermediate transfer element to a sheet of paper. Generally, the bearing surface of the photoreceptor after a primary transfer and the bearing surface of the intermediate transfer element after a secondary transfer will be subjected to cleaning with a cleaning element to prepare for the next toner image formation and primary transfer. In cleaning, since the cleaning elements, such as a blade, contact the bearing surfaces of the photoreceptor and the intermediate transfer element, there is a possibility that the shortage of the amount of residual toner which remains on the bearing surfaces may damage to the bearing surfaces.

Accordingly, in relation to the cleaning of the intermediate transfer element, the image forming apparatus disclosed in Japanese Patent Laid-Open Publication No. 2006-251138 transfers a cleaning toner image (a toner band) to an intermediate transfer element of which a bearing surface revolves. By forming a toner band in cleaning the bearing surface of the intermediate transfer element, sufficient amount of toner is replenished to the bearing surface of the intermediate transfer element and damage of the bearing surface due to the contact of a cleaning element can be prevented. This technology can be also applied to when a photoreceptor is cleaned, and can prevent the bearing surface of the photoreceptor from being damaged by forming a toner band for photoreceptors.

In addition, onto the surface of a secondary transfer element disposed so as to face the bearing surface of the intermediate transfer element with a sheet of paper held therebetween in a secondary transfer position, the toner which has remained on the bearing surface of the intermediate transfer element may be transferred, and when the transferred toner is left as it is, the reverse side of the sheet will be contaminated or stained. Therefore, the surface of the secondary transfer element also needs to be cleaned with a cleaning element and one conceivable approach in order to prevent the surface of the secondary transfer element in cleaning from being damaged is to form a toner band for the secondary transfer element.

However, when a toner amount necessary in order to prevent damages to the bearing surface of the intermediate transfer element is replenished at a time with a single toner band, excess of the toner starts leaking downstream of the cleaning element in a moving direction of the intermediate transfer element, and, on the contrary, contaminates and stains the intermediate transfer element. On the other hand, when the necessary toner amount is replenished with a plurality of toner bands intermittently formed along the moving direction of the bearing surface of the intermediate transfer element, the cleaning will take longer.

In particular, the cleaning takes much longer when a toner band is formed for each of the plurality of image formation elements such as a photoreceptor, an intermediate transfer element, and a secondary transfer element.

In view of these problems, an object of the present invention is to provide an image forming apparatus capable of efficiently forming a toner band for each of a plurality of image formation elements, and preventing cleaning of the plurality of image formation elements from taking longer.

SUMMARY OF THE INVENTION

An image forming apparatus according to the present invention includes a plurality of image forming elements including a photoreceptor, the plurality of image forming elements each having a surface that revolves and transferring a toner image formed on the photoreceptor to a sheet of paper, and further includes a transfer portion, a plurality of cleaning elements, and a control portion.

The transfer portion transfers a toner image from a first image forming element to a second image forming element among a plurality of image forming elements when transfer voltage is applied. Each of the plurality of cleaning elements contacts and cleans each surface of the plurality of image forming elements. The control portion controls formation of the toner image to the photoreceptor, as well as application of the transfer voltage to the transfer portion. The control portion, at time of cleaning the plurality of image forming elements, after integrally forming a cleaning toner image to be supplied to the first image forming element and the second image forming element on the surface of the photoreceptor along a revolving direction, controls the application of the transfer voltage to the transfer portion to transfer the toner image in a manner such that the toner image is divided into at least four sections along the revolving direction, out of which at least two sections that are not adjacent to each other are transferred from the first image forming element to the second image forming element.

The foregoing and other features and attendant advantages of the present invention will become more apparent from the reading of the following detailed description of the invention in conjunction with the accompanying drawings.

DETAILED DESCRIPTION OF THE INVENTION

Figure 1:
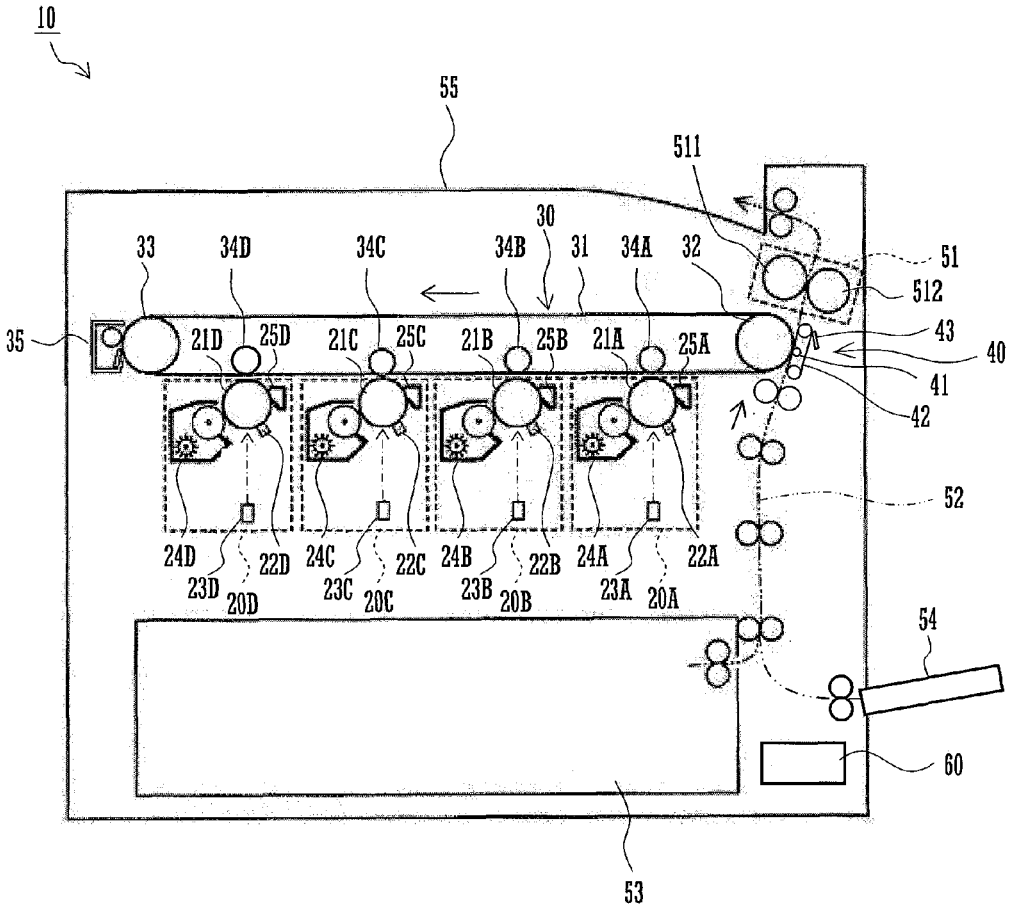
FIG. 1 is a schematic view of an image forming apparatus according to an embodiment of the present invention.

As shown in FIG. 1, the image forming apparatus 10 according to the embodiment of the present invention operates in either of a monochrome image formation mode or a full color image formation mode, and forms a monochrome image or a multicolor image on a sheet of paper based on image data.

The image forming apparatus 10 is provided with a plurality of image forming portions 20A, 20B, 20C, and 20D, an intermediate transfer unit 30, a secondary transfer unit 40, a fixing device 51, a paper feed path 52, a sheet feed cassette 53, a manual feed tray 54, a paper output tray 55, and a control portion 60. The control portion 60 controls each part of the image forming apparatus 10 in an integrated manner.

The image forming portion 20A is provided with a photoreceptor drum (which is equivalent to a photoreceptor of the present invention) 21A, an electrostatic charger device 22A, an exposure device 23A, a developing device 24A, and a cleaning unit 25A and is configured to form a black toner image on the surface of the photoreceptor drum 21A through an electrophotographic image forming process.

The charging device 22A electrostatically charges a revolving peripheral surface of the photoreceptor drum 21A to a predetermined potential. The exposure unit 23A illuminates image light that is modulated with image data corresponding to black color and forms a black electrostatic latent image on the peripheral surface of the photoreceptor drum 21A. The developing device 24A supplies a black toner onto the peripheral surface of the photoreceptor drum 21A and develops the electrostatic latent image to a toner image. The cleaning unit 25A collects residual toner which remains on the peripheral surface of the photoreceptor drum 21A by making the tip portion of the cleaning element contact the surface of the photoreceptor drum 21A.

The image forming portions 20B to 20D have the same configuration as the image forming portion 20A and are configured to form a cyan toner image, a magenta toner image and a yellow toner image on the surfaces of the photoreceptor drums 21B to 21D, respectively.

The intermediate transfer unit 30 has an intermediate transfer belt 31, a driving roller 32, a driven roller 33, primary transfer rollers 34A to 34D, and an intermediate transfer belt cleaning unit 35.

The secondary transfer unit 40 is provided with a secondary transfer roller 41, a secondary transfer belt 42, and a secondary transfer belt cleaning element 43.

Hereinafter, with reference to FIGS. 2 to 5, description is directed to a case where the intermediate transfer belt 31 is equivalent to a first image forming element defined by the present invention, the secondary transfer belt 42 is equivalent to a second image forming element defined by the present invention, an intermediate transfer belt cleaning element 351 and the secondary transfer belt cleaning element 43 are equivalent to cleaning elements defined by the present invention, and the secondary transfer roller 41 is equivalent to a transfer portion defined by the present invention.

Figure 2:
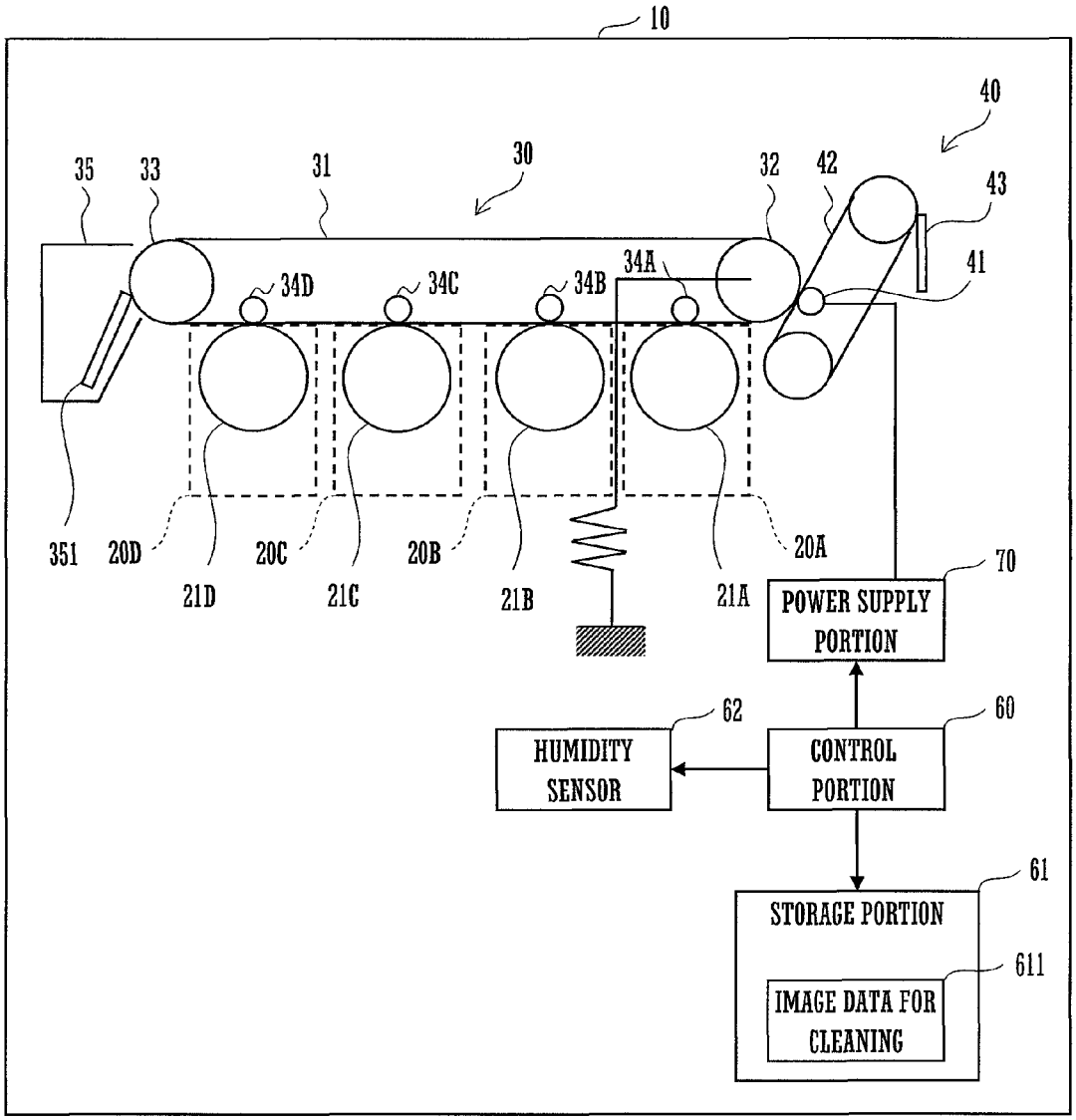
FIG. 2 is a schematic diagram showing peripheral parts of an intermediate transfer unit and a secondary transfer unit in the image forming apparatus.

As shown in FIG. 2, the intermediate transfer belt 31 is stretched over the driving roller 32 and the driven roller 33, and revolves along a circulation route that passes through the image forming portions 20D, 20C, 20B, and 20A in this order. The outer peripheral surface of the intermediate transfer belt 31 faces the photoreceptor drums 21A to 21D. The primary transfer rollers 34A to 34D are disposed facing the photoreceptor drums 21A to 21D, respectively, with the intermediate transfer belt 31 held therebetween, and primarily transfer the toner images formed on the peripheral surfaces of the respective photoreceptor drums 21A to 21D onto the outer peripheral surface of the intermediate transfer belt 31.

In a full color image forming process, yellow, magenta, cyan, and black toner images are sequentially transferred to the surface of the intermediate transfer belt 31 in an overlaying manner. In a monochrome image forming process, only a black toner image is transferred onto the surface of the intermediate transfer belt 31.

The intermediate transfer belt cleaning unit 35 has the intermediate transfer belt cleaning element 351. The intermediate transfer belt cleaning element 351 makes a tip portion thereof contact the surface of the intermediate transfer belt 31, and cleans the outer peripheral surface of the intermediate transfer belt 31 after secondary transfer.

In the secondary transfer unit 40, the secondary transfer belt 42 is stretched over a plurality of rollers, and revolves along a predetermined circulation route. The secondary transfer roller 41 is disposed facing the driving roller 32 with the secondary transfer belt 42 and the intermediate transfer belt 31 held therebetween, and secondarily transfers, by application of the transfer voltage, the toner image formed on the outer peripheral surface of the intermediate transfer belt 31 to a sheet of paper that is fed between the intermediate transfer belt 31 and the secondary transfer belt 42.

Onto the surface of the secondary transfer belt 42, the toner that has remained on the outer peripheral surface of the intermediate transfer belt 31 may be transferred. The secondary transfer belt cleaning element 43 makes the tip portion thereof contact the surface of the secondary transfer belt 42, and then cleans from the surface of the intermediate transfer belt 31 to the surface of the secondary transfer belt 42.

The image forming apparatus 10 further includes a control portion 60, a storage portion 61, a humidity sensor 62, and a power supply portion 70.

The storage portion 61 stores image data 611 for cleaning. The image data 611 for cleaning is image data for forming a cleaning toner image (a toner band) in a predetermined range of the circumferential direction over the whole area throughout an image formation area in the axial direction of the photoreceptor drum 21A. The humidity sensor 62 detects the humidity of the inside of the image forming apparatus 10.

The secondary transfer roller 41 is connected to the power supply portion 70. The power supply portion 70 applies the transfer voltage with a polarity opposite to the polarity of electrostatically charged toner to the secondary transfer roller 41 based on the control data outputted from the control portion 60. It is to be noted that the driving roller 32 is grounded.

Figure 3:
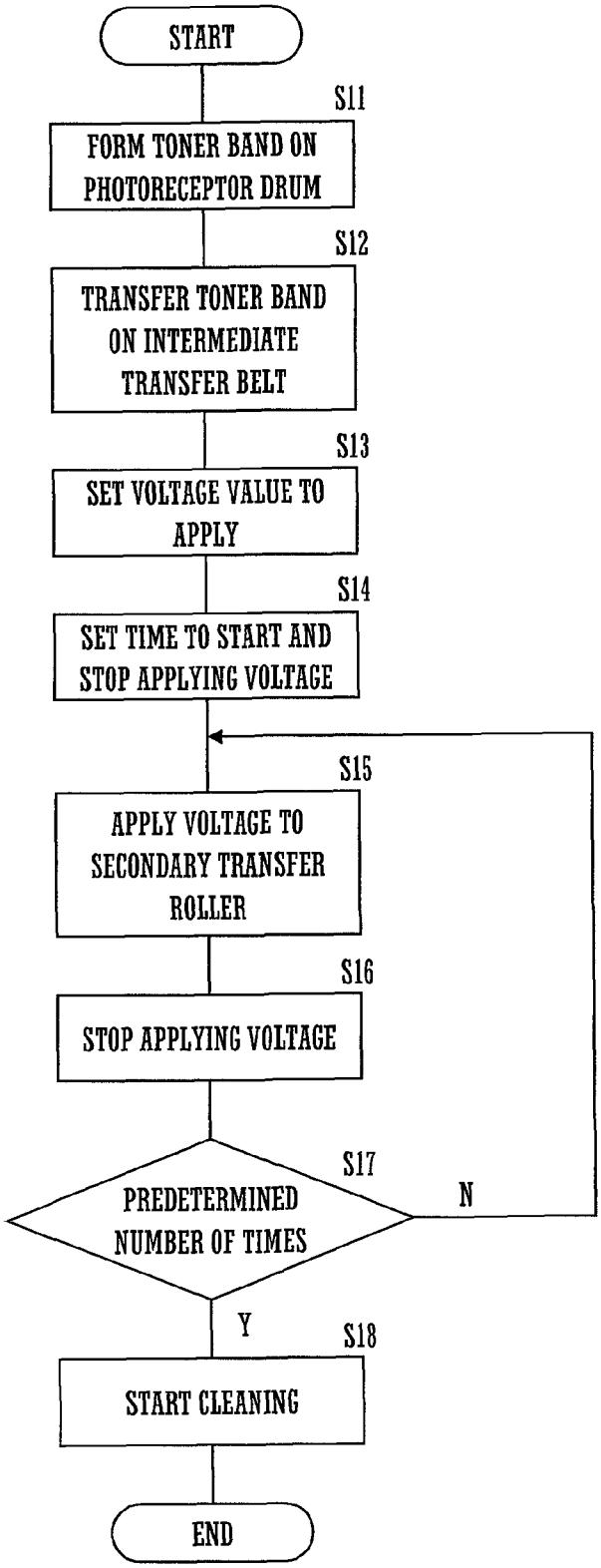
FIG. 3 is a flow chart at time of cleaning of a control portion in the image forming apparatus.

As shown in FIG. 3, the control portion 60 performs a process in relation to cleaning when the image forming processes of predetermined number of times are finished and when a not illustrated operating portion receives a cleaning instruction. The control portion 60 first integrally forms a toner band for the intermediate transfer belt 31 and a toner band for the secondary transfer belt 42 on the surface of the photoreceptor drum 21A along the circumferential direction by using the image data 611 for cleaning that the storage portion 61 stores (S11).

Furthermore, the control portion 60 applies the transfer voltage with a polarity opposite to the polarity of electrostatically charged toner to the primary transfer roller 34A, and transfers the toner band onto the outer peripheral surface of the intermediate transfer belt 31 (S12). It is to be noted that toner bands may be each formed on each of the photoreceptor drums 21A to 21D and may be transferred onto the surface of the intermediate transfer belt 31.

Subsequently, the control portion 60 calculates a voltage value of the transfer voltage based on the humidity which the humidity sensor 62 has detected, and sets the value to the power supply portion 70 (S13). When the humidity is higher, the intermediate transfer belt 31 made of polyimide becomes hard to be electrically charged and the secondary transfer belt 42 made of NBR rubber becomes easy to be electrically charged, so that the toner band will be easily transferred from the intermediate transfer belt 31 to the secondary transfer belt 42. Therefore, the control portion 60 sets the voltage value of the transfer voltage lower as the humidity becomes higher.

Thereafter, the control portion 60 sets time to start applying the transfer voltage and time to stop applying voltage against the secondary transfer roller 41 (S14). The control portion 60 applies the transfer voltage to the secondary transfer roller 41 only for the set time to apply voltage (S15), and stops applying the transfer voltage only for the set time to stop applying voltage (S16). The control portion 60 repeats to switch between the application of the transfer voltage and the stop application of the transfer voltage alternately each for the predetermined number of times (at least twice) (S17).

Figure 4A:
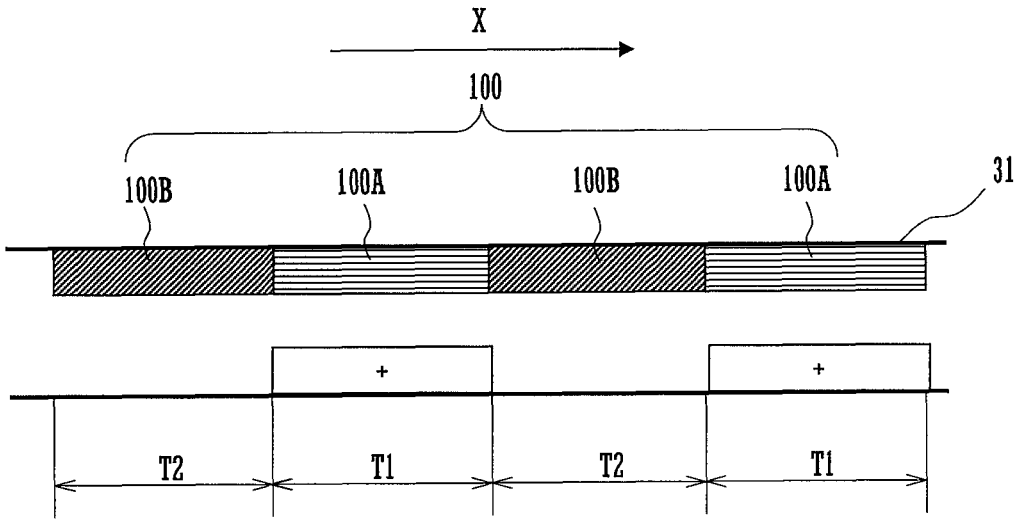
FIGS. 4A and 4B show examples of formation of toner bands when time to apply voltage and time to stop applying voltage are equal and when the time to apply voltage and the time to stop applying voltage are different.
Figure 4B:
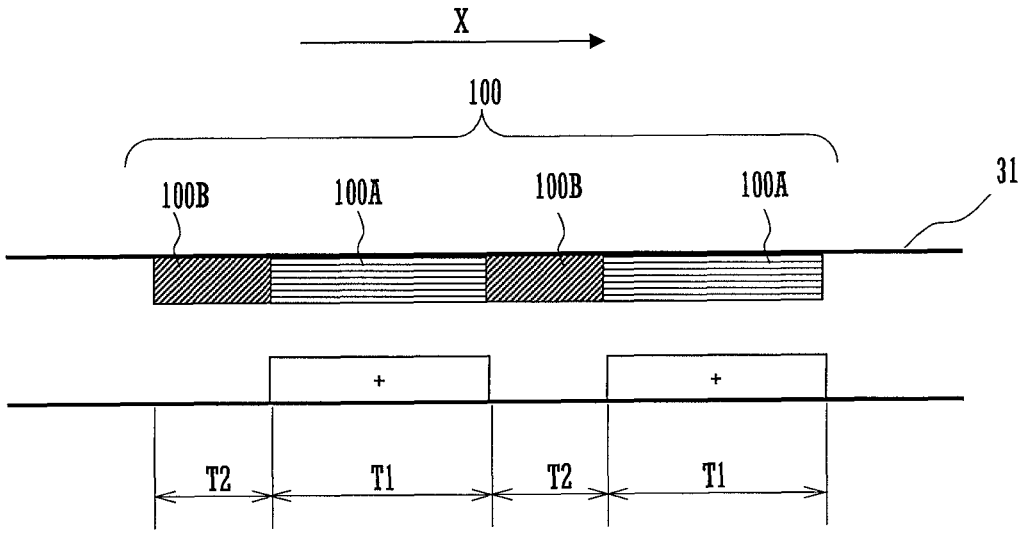

As shown in FIGS. 4A and 4B, the control portion switches between the application of the transfer voltage and the stop application of the transfer voltage so that the toner band 100 is divided into at least four sections along the revolving direction (in the direction arrow X) of the intermediate transfer belt 31, and a section 100A to be transferred to the secondary transfer belt 42 and a section 100B to be left on the intermediate transfer belt 31 are alternately arranged.

The toner band is transferred from the intermediate transfer belt 31 to the secondary transfer belt 42 only during the application of the transfer voltage. As time to apply the transfer voltage and time to stop applying the transfer voltage are adjusted, the amount of the toner band increases and decreases, the amount being supplied to each of the intermediate transfer belt 31 and the secondary transfer belt 42.

For example, as shown in FIG. 4A, when time T1 to apply the transfer voltage is set equal to time T2 to stop applying the transfer voltage, the section 100A and the section 100B will have the same length in the direction arrow X and the same amount of toner is supplied to both the intermediate transfer belt 31 and the secondary transfer belt 42. Additionally, as shown in FIG. 4B, when time T1 to apply the transfer voltage is set longer than time T2 to stop applying the transfer voltage, the section 100A will be longer than the section 100B in the direction arrow X and more amount of toner is supplied to the secondary transfer belt 42 compared to the intermediate transfer belt 31.

The control portion 60, after finishing formation of a toner band by repeating switching between the application of the transfer voltage and the stop application of the transfer voltage each for the predetermined number of times, starts cleaning with the intermediate transfer belt cleaning element 351 and with the secondary transfer belt cleaning element 43 (S18).

It is to be noted that the process in S13 is not indispensable and the power supply portion 70 may apply the transfer voltage to the secondary transfer roller 41 with a predetermined voltage value.

As described above, the image forming apparatus 10 can integrally form a toner band to be supplied, in a predetermined number of times, to each of the intermediate transfer belt 31 and the secondary transfer belt 42 along the revolving direction of the surface of the photoreceptor drum 21A. Accordingly, the intermediate transfer belt 31 and the secondary transfer belt 42 can be properly cleaned without requiring a long time for the formation of the toner band.

In particular, since the toner image is not directly transferred to the secondary transfer belt 42 during the image formation process, the secondary transfer belt 42 is highly likely to have less amount of residual toner than the intermediate transfer belt 31 onto which the toner image is directly transferred during the image formation process. The intermediate transfer belt 31 and the secondary transfer belt 42 can be more properly cleaned by adjusting time to apply the transfer voltage and time to stop applying the transfer voltage so that the total amount of residual toner for the intermediate transfer belt 31 and residual toner for the secondary transfer belt 42 equals the amount of toner supplied by the toner band.

Figure 5A:
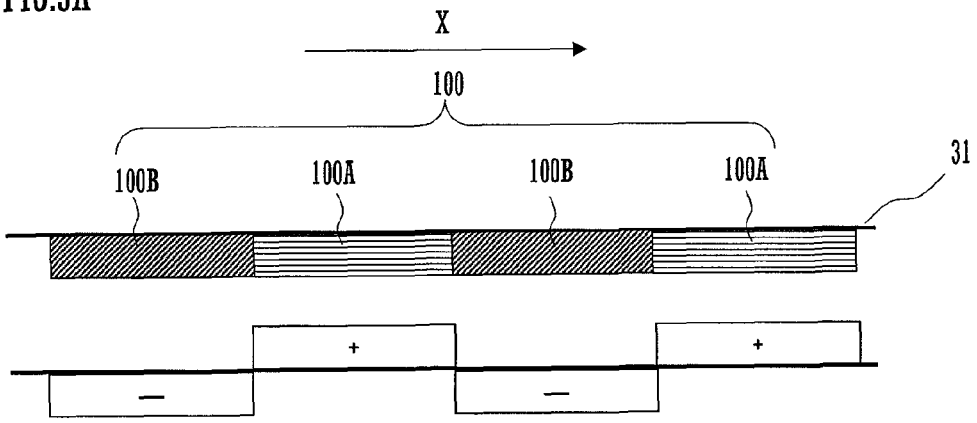
FIGS. 5A to 5C show examples of formation of toner bands when transfer voltage with a polarity opposite to a polarity of electrostatically charged toner band is equal to the transfer voltage with the same polarity as the polarity of the electrostatically charged toner band, when the transfer voltage with the polarity opposite to the polarity of the electrostatically charged toner band is different from the transfer voltage with the same polarity as the polarity of the electrostatically charged toner band, and when the transfer voltage has different voltage values.
Figure 5B:
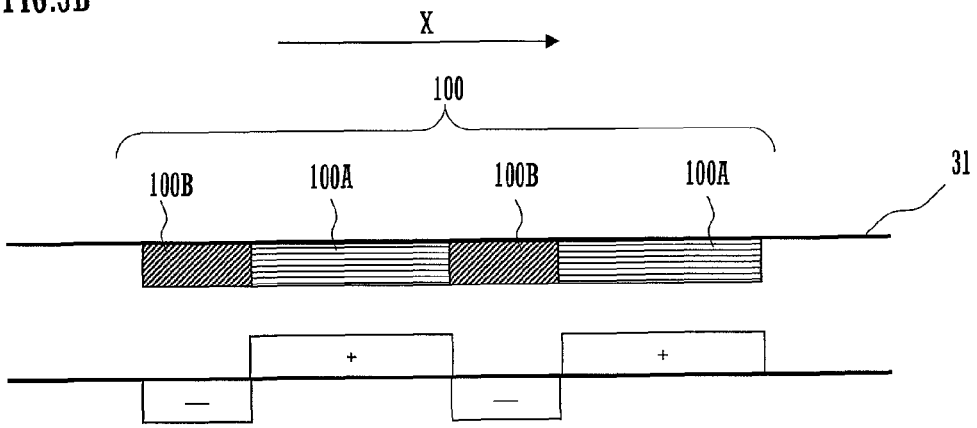

It should be understood that, as shown in FIGS. 5A and 5B, the transfer voltage with a polarity opposite to the polarity of the electrostatically charged toner and the transfer voltage with the same polarity as the polarity of the electrostatically charged toner may be alternately applied to the secondary transfer roller 41. Therefore, the toner band for the intermediate transfer belt 31 can be surely formed on the intermediate transfer belt 31.

Figure 5C:
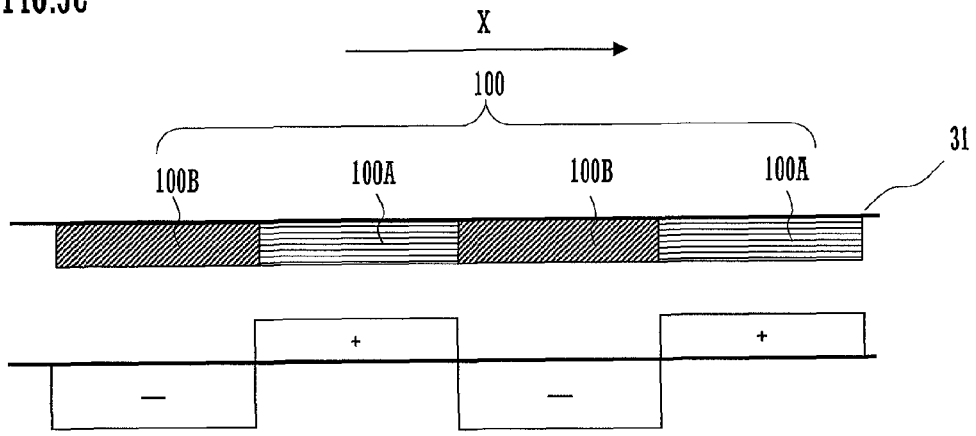

In addition, as shown in FIG. 5C, as the humidity in the image forming apparatus 10 rises, the voltage value of the transfer voltage with the same polarity as the polarity of the electrostatically charged toner applied to the secondary transfer roller 41 may be set higher than the voltage value of the transfer voltage with a polarity opposite to the polarity of the electrostatically charged toner applied to the secondary transfer roller 41. When the humidity in the image forming apparatus 10 rises, a toner band for the intermediate transfer belt 31 can be surely formed on the intermediate transfer belt 31 that becomes harder to be electrically charged, compared to the secondary transfer belt 42. On the other hand, since the toner easily moves from the intermediate transfer belt 31 that becomes hard to be electrically charged to the secondary transfer belt 42 that becomes easy to be electrically charged as the humidity rises, it is not necessary to increase the voltage value of the transfer voltage with a polarity opposite to the polarity of the electrostatically charged toner.

Subsequently, with reference to FIGS. 6 and 7, description is directed to a case where the photoreceptor drums 21A to 21D are defined as first image forming elements in the present invention, the intermediate transfer belt 31 is defined as a second image forming element of the present invention, cleaning units 25A to 25D and an intermediate transfer belt cleaning element 351 are defined as a cleaning element of the present invention, and primary transfer rollers 34A to 34D are defined as a transfer portion.

Figure 6:
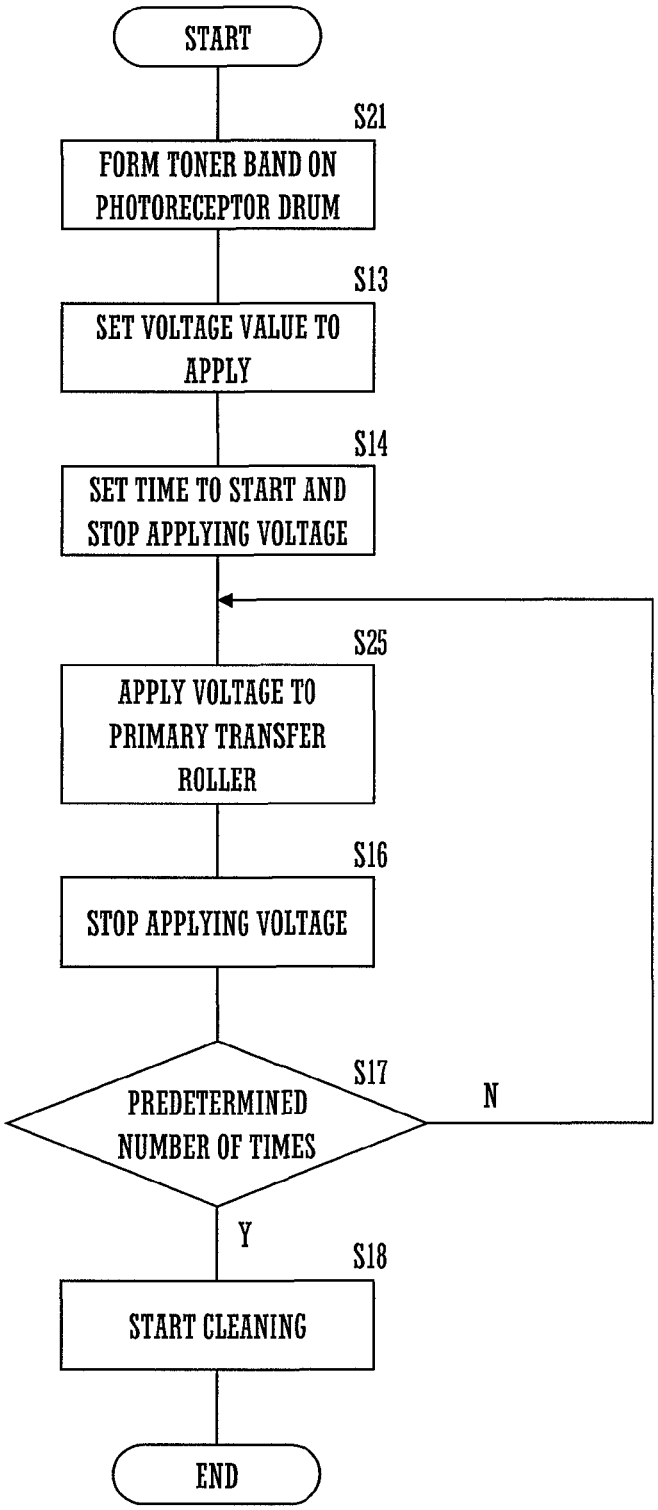
FIG. 6 is another flow chart at time of cleaning of the control portion in the image forming apparatus.

As shown in FIG. 6, the control portion 60 integrally forms toner bands for the photoreceptor drums 21A to 21D and a toner band for the intermediate transfer belt 31 on the surfaces of the photoreceptor drums 21A to 21D (S21), after performing the same process as the process in S13 as shown in FIG. 3, repeats to switch between the application and the stop application of the transfer voltage with a polarity opposite to the polarity of the electrostatically charged toner against the primary transfer rollers 34A to 34D alternately for the predetermined number of times (at least twice) (S25, S16, S17).

Figure 7A:
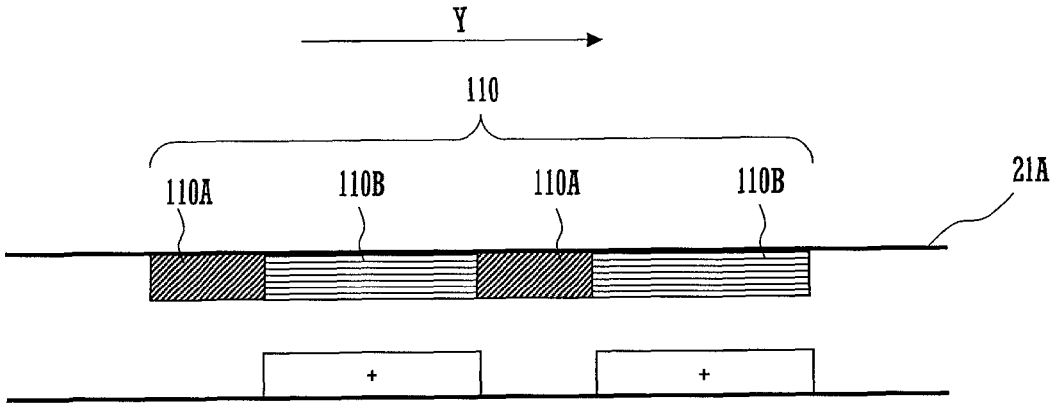
FIGS. 7A and 7B show examples of formation of toner bands when a toner image is transferred from a photoreceptor drum to an intermediate transfer belt and when a toner image is transferred from the intermediate transfer belt to a secondary transfer belt.

By performing the process, as shown in FIG. 7A, the image forming apparatus 10 can integrally form a toner band 110A for the photoreceptor drum 21A and a toner band 110B for the intermediate transfer belt 31 on the surface of the photoreceptor drum 21A with a predetermined distance therebetween. Accordingly, the photoreceptor drums 21A to 21D and the intermediate transfer belt 31 can be surely cleaned without making the cleaning take longer.

It is to be noted here that the process as shown in FIG. 6 can be applied to an image forming apparatus that has a paper feed belt in place for the intermediate transfer belt 31 as shown in FIG. 2 and sequentially transfers the toner images on the surfaces of the photoreceptor drums 21A to 21D to a sheet of paper that is fed by the paper feed belt.

Moreover, the photoreceptor drums 21A to 21D are defined as first image forming elements of the present invention, the secondary transfer belt 42 can be defined as a second image forming element of the present invention, the cleaning units 25A to 25D and the secondary transfer belt cleaning element 43 can be defined as a cleaning element of the present invention, and the primary transfer rollers 34A to 34D and the secondary transfer roller 41 can also be defined as a transfer portion.

In this case, the control portion 60 integrally forms toner bands for the photoreceptor drums 21A to 21D and a toner band for the secondary transfer belt 42 on the surfaces of the photoreceptor drums 21A to 21D in process S21 as shown in FIG. 6. The control portion 60 transfers all the toner bands transferred to the intermediate transfer belt 31 to the secondary transfer belt 42 after performing the process S17 as shown in FIG. 6.

Furthermore, toner bands for the photoreceptor drums 21A to 21D, a toner band for the intermediate transfer belt 31, and a toner band for the secondary transfer belt 42 can also be integrally formed on each of the surfaces of the photoreceptor drums 21A to 21D.

Figure 7B:
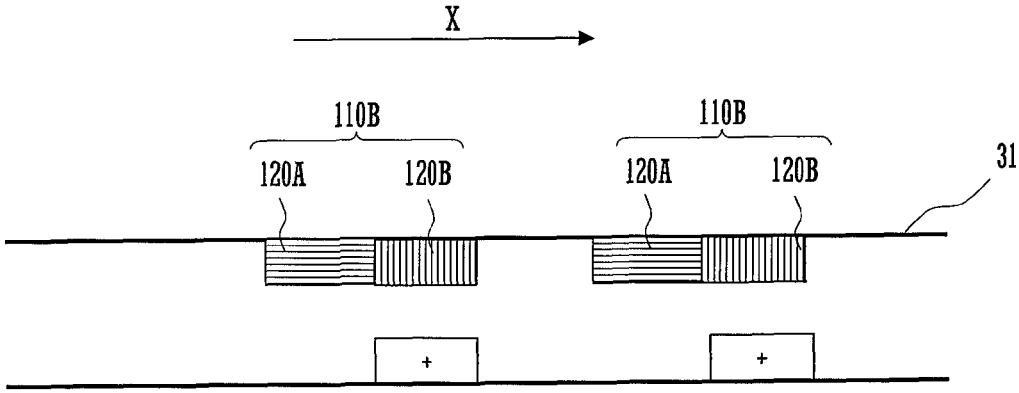

In this case, the control portion 60 integrally forms toner bands for the photoreceptor drums 21A to 21D, a toner band for the intermediate transfer belt 31, and a toner band for the secondary transfer belt 42 on each of the surfaces of the photoreceptor drums 21A to 21D in process S21 as shown in FIG. 6. The control portion 60, after performing the process S17 as shown in FIG. 6, divides the toner band 110B transferred to the intermediate transfer belt 31 into a toner band 120A for the intermediate transfer belt 31 and a toner band 120B for the secondary transfer belt 42 along the revolving direction X, as shown in FIG. 7B.

Moreover, in an image forming apparatus that connects the power supply portion 70 to the driving roller 32 which stretches the intermediate transfer belt 31, and applies the transfer voltage for secondary transfer to the driving roller 32, the transfer voltage with the same polarity as the polarity of the electrostatically charged toner may be applied to the driving roller 32 when the toner band for the secondary transfer belt 42 is supplied from the intermediate transfer belt 31 to the secondary transfer belt 42.

The above described embodiments are to be considered in all respects as illustrative and not restrictive. The scope of the present invention is defined not by above described embodiments but by the claims. Further, the scope of the present invention is intended to include all modifications that come within the meaning and scope of the claims and any equivalents thereof.

What is claimed is:

1. An image forming apparatus having a plurality of image forming elements including a photoreceptor, the image forming elements each having a surface that revolves and transferring a toner image formed on the photoreceptor to a sheet of paper, the image forming apparatus comprising:

a transfer portion that, when transfer voltage is applied, transfers the toner image from a first image forming element to a second image forming element among the plurality of image forming elements;

a plurality of cleaning elements of which each cleans each surface of the plurality of image forming elements; and a control portion that controls formation of the toner image to the photoreceptor, as well as application of the transfer voltage to the transfer portion, wherein the control portion, at time of cleaning the plurality of image forming elements, after integrally forming a cleaning toner image to be supplied to the first image forming element and the second image forming element on a surface of the photoreceptor along a revolving direction, switches polarity or an application state of the transfer voltage to the transfer portion to transfer the toner image in a manner such that the toner image is divided into at least four sections along the revolving direction of the first image forming element, out of which at least two sections that are not adjacent to each other are transferred from the first image forming element to the second image forming element.

2. The image forming apparatus according to claim 1, wherein the control portion intermittently applies the transfer voltage to the transfer portion at time of cleaning the plurality of image forming elements.

3. The image forming apparatus according to claim 1, further comprising a humidity sensor that detects humidity, wherein the control portion adjusts the transfer voltage based on a detection result from the humidity sensor at time of cleaning the plurality of image forming elements.

4. The image forming apparatus according to claim 1, further comprising:

an intermediate transfer belt to which the toner image formed on the photoreceptor is to be primarily transferred; and a secondary transfer element that secondarily transfers the toner image that has been primarily transferred to the intermediate transfer belt to a sheet of paper that passes between the intermediate transfer belt and the secondary transfer element, wherein the intermediate transfer belt is the first image forming element and the secondary transfer element is the second image forming element.

5. The image forming apparatus according to claim 1, further comprising:

an intermediate transfer belt to which the toner image formed on the photoreceptor is to be primarily transferred; and a secondary transfer element that secondarily transfers the toner image that has been primarily transferred to the intermediate transfer belt to a sheet of paper that passes between the intermediate transfer belt and the secondary transfer element, wherein the photoreceptor is the first image forming element and the intermediate transfer belt is the second image forming element.

* * * * *